United States Patent [19]

Schust

[11] Patent Number: 4,503,732

[45] Date of Patent: Mar. 12, 1985

[54] WINDOW LIFTER DRIVE FOR MOTOR VEHICLES AND THE LIKE

[75] Inventor: Gerhard Schust, Weidhausen, Fed. Rep. of Germany

[73] Assignee: Brose Fahrzeugteile GmbH & Co., Coburg, Fed. Rep. of Germany

[21] Appl. No.: 439,301

[22] Filed: Nov. 4, 1982

[30] Foreign Application Priority Data

Dec. 8, 1981 [DE] Fed. Rep. of Germany ..... 3148523

[51] Int. Cl.[3] ..... G05G 1/08

[52] U.S. Cl. ..... 74/625; 74/505; 49/352; 254/339

[58] Field of Search ..... 49/352, 348, 349; 74/505, 625; 254/339, 375; 242/54 R

[56] References Cited

U.S. PATENT DOCUMENTS

| | | | |
|---|---|---|---|
| 1,260,550 | 3/1918 | Kopp | 49/352 |
| 1,835,354 | 12/1931 | Stockman et al. | 74/625 |
| 1,848,435 | 3/1932 | Richards | 74/505 |
| 2,254,989 | 9/1941 | Benson | 74/505 X |
| 2,299,402 | 10/1942 | Mersereau | 74/505 |
| 2,439,941 | 4/1948 | Lounsbury | 74/505 |
| 2,485,026 | 10/1949 | Williams | 74/505 |
| 2,492,080 | 12/1949 | Williams | 74/505 |
| 3,022,064 | 2/1962 | Russell | 49/352 |
| 3,280,509 | 10/1966 | Werner | 49/352 |
| 3,742,781 | 7/1973 | Boyriven | 74/625 |
| 3,791,021 | 2/1974 | Niklaus | 74/625 |
| 4,085,629 | 4/1978 | Fogarollo | 74/625 |
| 4,191,060 | 3/1980 | Sessa | 49/352 |
| 4,216,624 | 8/1980 | Blankenburg et al. | 49/352 |
| 4,229,906 | 10/1980 | Pickus | 49/352 |
| 4,367,660 | 1/1982 | Becker et al. | 74/625 |

FOREIGN PATENT DOCUMENTS

| | | | |
|---|---|---|---|
| 1287471 | 1/1969 | Fed. Rep. of Germany | 49/352 |
| 1630609 | 3/1970 | Fed. Rep. of Germany . | |
| 1708164 | 8/1971 | Fed. Rep. of Germany . | |
| 2830449 | 1/1980 | Fed. Rep. of Germany | 49/352 |
| 3008296 | 3/1980 | Fed. Rep. of Germany . | |
| 1519251 | 2/1968 | France | 254/375 |
| 2489451 | 3/1982 | France | 74/625 |
| 840532 | 7/1960 | United Kingdom | 254/375 |

*Primary Examiner*—Kenneth J. Dorner

*Attorney, Agent, or Firm*—Toren, McGeady and Stanger

[57] ABSTRACT

In a window lifter drive for motor vehicles a base member contains a cable drum to which a manual crank handle drive or a motor drive can be selectively secured. The base member includes a housing enclosing the cable driven with an opening on one side for a pinion on the crank handle drive. The housing has an opening on the opposite side for a driving claw part of the motor drive. Each of the pinion and the driving claw part can act directly on the cable drum.

27 Claims, 5 Drawing Figures

WINDOW LIFTER DRIVE FOR MOTOR VEHICLES AND THE LIKE

SUMMARY OF THE INVENTION

The present invention is directed to a window lifter drive, in particular for motor vehicles, including a driving member supported in a housing with a crank handle drive or a motor drive arranged for powering the driving member. The driving member may be a cable drum.

Such known window lifter drives have always been produced either as manually driven or motor driven parts with the manual crank handle drive or the motor drive forming an integral part of the window lifter drive housing.

Therefore, the primary object of the present invention is to provide a window lifter drive in which the driving member within the housing can be selectively operated either manually or by a motor drive.

In accordance with the present invention, alternatively the crank handle drive or the motor drive can be secured on the housing, preferably each on an opposite side of the housing. In addition to the lower production costs for the individual parts of the window lifter drive achieved with the present invention, there is the further advantage that it is possible to preassemble the window lifter regardless of the drive selected. Accordingly, the housing can be preassembled on a carrier such as the combination of an interior door paneling and lining and it can be produced as a single unit from plastics, for example, polyurethane, with corresponding reinforcements.

To ensure a simple construction the housing can be formed with an opening through which the pinion of a crank handle drive can be inserted with the driving member provided on one side with interior toothing for engagement with the pinion. Further, the housing can be provided with another opening for a driving member, preferably a driving claw part engageable with the driving member on another one of its surfaces so that the driving member and the driving claw part can be engaged.

A more compact and mechanically more stable construction is ensured if the driving member, in the form of a cable drum, is supported against the opposite side walls of the housing which contain the openings for the crank handle drive and for the motor drive. Preferably the support is afforded by a projection on the housing in the region of the outer edges of the side faces. The projection reliably seals the cable drum periphery around the opening through the housing.

During operation relatively high turning moments can be exerted from the traction cable to the cable drum. For the problem-free absorption of such moments it is suggested that the cable drum be rotatably supported at its outer circumference within the housing, preferably by forming circumferentially extending areas on the both drum edges for engagement with corresponding inside circumferential surfaces on the housing.

In another embodiment of the invention, the cable drum is rotatably supported by an inner circumferential surface within a central recess on a bearing section extending inwardly from a side wall of the housing. Such a pivot bearing runs especially easily, and where a two part housing is employed, a most accurate assembly of the housing is not important, since the cable drum is rotatably supported only on one side wall of the housing.

A more compact and sturdy construction of the assembled window lifter drive is ensured if the bearing section is also formed as a pivot bearing for the pinion.

The production and assembly costs of the window lifter drive are comparatively low if the housing, in accordance with the present invention, is formed of two parts, preferably one part having a wall containing the opening for the pinion and the other part having an opening for the driving claw part. For a further reduction in assembly costs, it is proposed that both parts of the housing be clipped together. To prevent self-acting window glass movement, the crank handle drive is provided with a jaw clutch provided with a loop spring brake with one part of the jaw clutch non-rotatably connected with the pinion, preferably integral with the pinion and with the other jaw clutch part non-rotatably secured to the crank handle. To reduce the structural length, it is proposed that one part of the jaw clutch is rotatably supported on the other part.

Another feature of the invention is that a loop spring brake jacket can be fastened onto the housing, preferably by a screw engagement. To connect the crank handle drive to the housing only the loop spring brake jacket needs to be screwed onto the housing.

To retain the loop spring brake and the jaw clutch within the loop spring brake jacket against displacement before fastening the loop spring brake jacket on the housing and for a simple support of the pinion, it is proposed to fasten a bearing unit on the loop spring brake jacket, preferably by riveting, with the bearing plate projecting into a central part of the cable drum for rotatably supporting the pinion. Alternatively, one or the other jaw parts can be used for rotatable support, preferably by means of a bearing opening in the bearing unit for a pinion pin.

A flange located between the crank handle and the loop spring brake jacket secures the window lifter drive on the interior door panel or on a carrier member.

In one especially preferred embodiment of the invention, based on its particularly simple construction, the pinion is rigidly fixed to the crank handle. As a result, the costly loop spring brake is not needed. The required braking action is produced by other devices in the window lifter, for example, by a brake acting between the carrier and the guide wheel so that the brake is released when the drive cable is running.

With the loop spring brake dispensed with, in accordance with the present invention, it is possible to fasten the housing directly to the interior door panel or on to a carrier member and, for this purpose, the housing is provided with corresponding fastening means, in particular, screw holes. The housing in the preassembled state is fastened onto the interior door panel or to the carrier member. In a later assembly stage, alternatively, the crank handle can be arranged on one side of the housing with the crank handle penetrating a corresponding recess in the interior door panel or in the carrier member, or the motor drive can be positioned on the opposite side of the housing.

To fix the crank handle and pinion in the axial direction, a pinion bolt connects the crank handle with the pinion and the pinion bolt is provided with a circumferential groove in which at least one preferably barb-shaped, radially elastically flexible projection on the housing engages. The barb-shaped arrangement ensures a simple mounting of the pinion bolt, that is, the pinion bolt is inserted into the housing until the barb-shaped projection engages in the circumferential groove.

A pinion pin for insertion into the bearing opening of the bearing projection is located on the side of the pinion remote from the crank handle for supporting the rigid crank handle-pinion bolt assembly.

To secure this rigid part in the axial direction, the section of the pinion pin projecting over the side of the bearing section remote from the crank handle can be secured against axial displacement in the direction of the crank handle, preferably by means of a self-locking securing disc.

In accordance with the present invention, the motor drive connectable to the housing includes a bearing shaft having one end rotatably supported in a central bearing opening in the driving member. With this arrangement a particularly short structural form is assured. The other end of the bearing shaft can be rotatably mounted in a motor drive hood. A worm wheel is provided on the bearing shaft.

For rotatably coupling the worm wheel with the driving member, the worm wheel is connected via a driving claw part with the driving member, preferably with the intermediate presence of at least one elastic part between the worm wheel and the driving claw part and/or between the driving claw part and the driving member. By providing an optional double cushion between the worm wheel and the driving member it is possible to ensure quiet smooth operation.

Finally, another feature of the invention involves connection of one of the elastic intermediate parts in the region of its outer periphery with a circular ring seal section for sealing the motor drive hood relative to the housing via a detachable connection, preferably a film connection. During assembly of the motor drive and the housing, the circular ring sealing section automatically attains the sealing position between the housing and the motor drive. As soon as the motor drive is turned on, the film connection tears so that the elastic intermediate part can rotate in an unimpeded manner along with the driving claw part.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
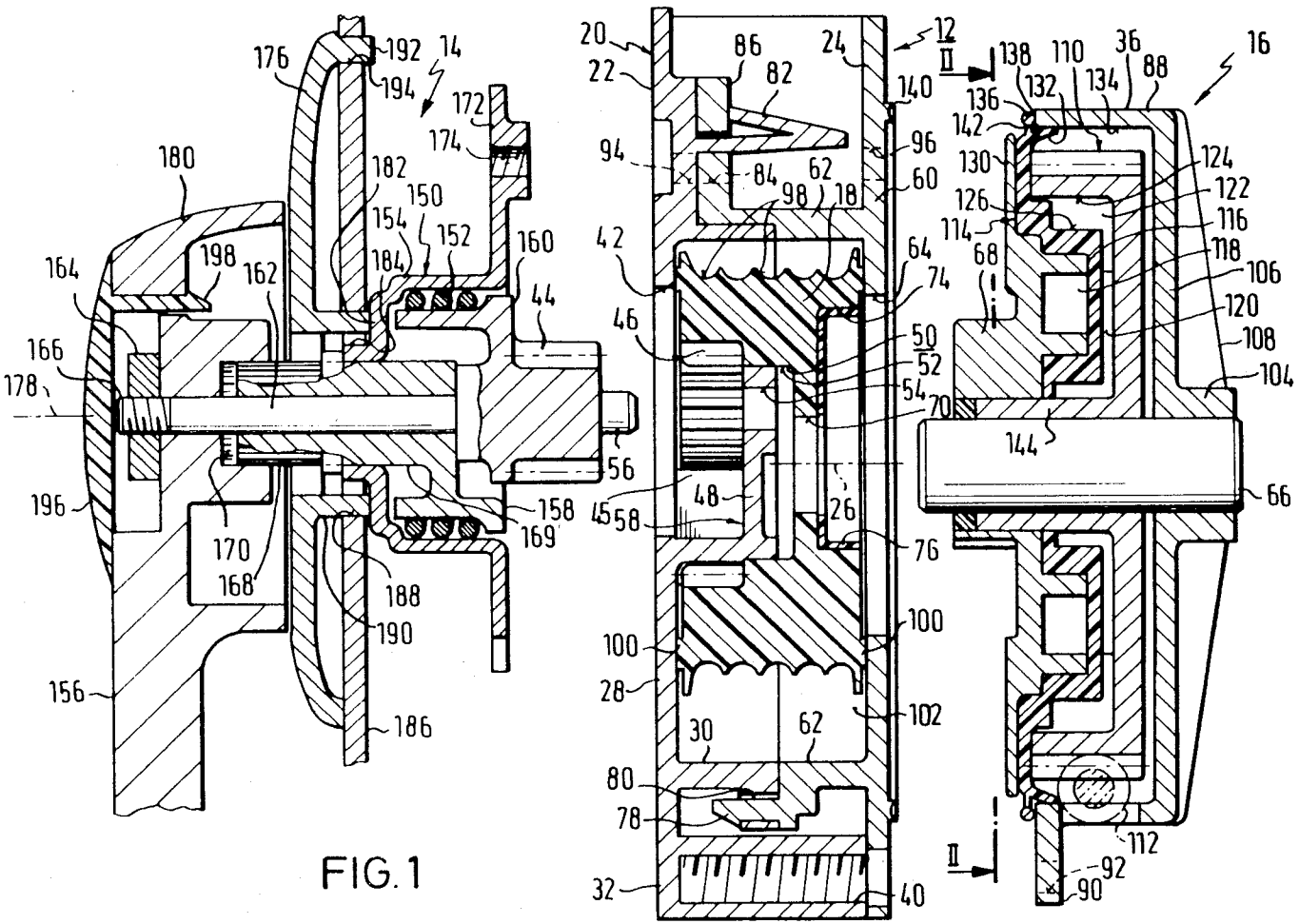
FIG. 1 is a sectional view of an embodiment of a window lifting drive, according to the present invention, showing the parts before they are assembled.

As illustrated in the drawing, a window lifting drive, embodying the present invention, is distinguished in that selectively a manual crank handle drive or a motor drive can be secured to a driving member with a base or housing.

In FIG. 1, a driving base 12 is shown. A crank handle drive 14 can be assembled on the base from the left-hand side and a motor drive 16 can be secured to the base on the right-hand side.

In FIG. 1, a driving member, in the form of a cable drum 18 for operating a window lifter, is supported in the base 12. A traction cable is wound around the cable drum 18 in a manner not shown, and the cable is guided in a closed loop extending from the cable drum to a turn-around member at one end of a guide rail, then it moves along the guide rail to a turn-around member at the other end before it returns to the cable drum 18. The traction cable section between cable drum 18 and the guide rail can extend through Bowden tubes. In the region between the turn-around members, a carrier or driver is fastened onto the traction cable and it is displaceable along the guide rail carrying a retaining rail which encompasses the lower transverse edge of a pane of window glass.

Figure 2:
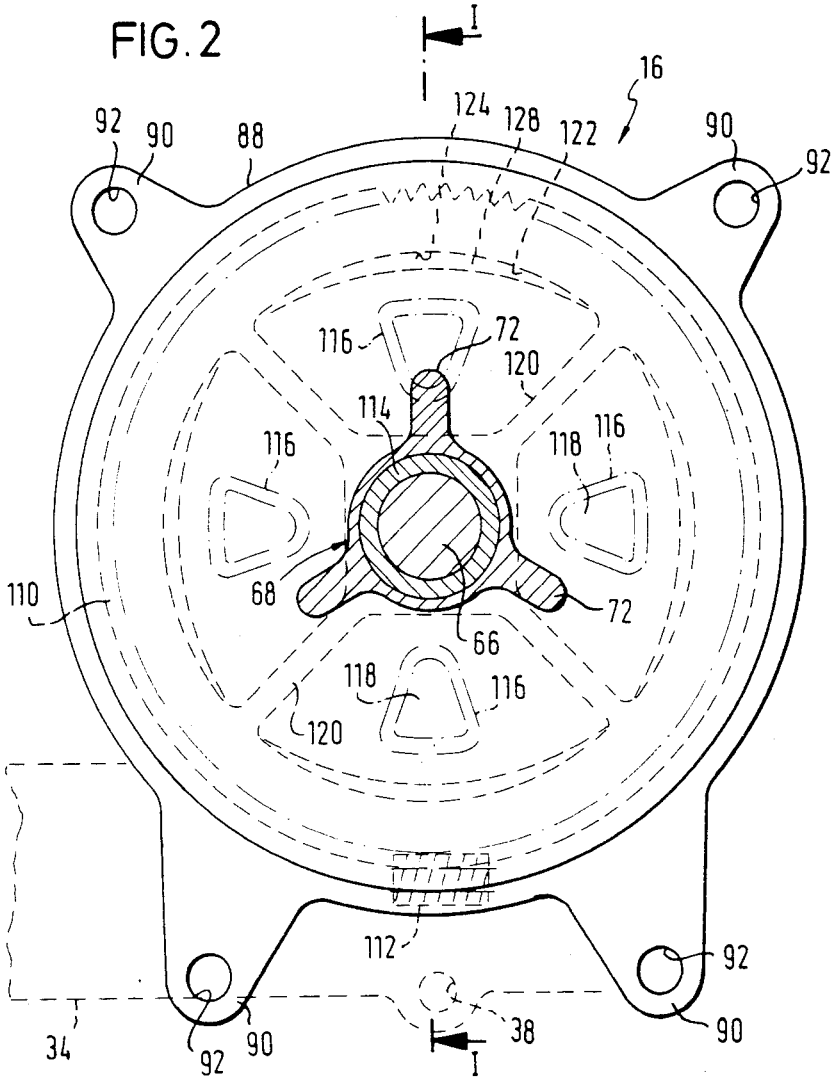
FIG. 2 is a sectional view taken along the line II—II through the right-hand part shown in FIG. 1.

Cable drum 18 is supported in a two-part housing 20 made up of a front part 22, at the left in FIG. 1, and a rear part 24. The front part 22 includes a front wall 28 extending perpendicularly to the axis 26 of the cable drum 18 and a cylindrical collar 30 extends perpendicularly from the wall 28 toward the rear part 24. Collar 30 encompasses half the axial length of the cable drum 18. In the lower part of the front part 22, a fixture 32 is arranged for fastening an electric motor 34 shown in dashed line in FIG. 2 but not otherwise shown in detail. The fixture 32 is provided in case the electric motor is not formed integrally with the motor gear box unit 36, note the motor drive 16. In FIG. 2, a fastening hole 38 is provided on the electric motor 34 so that a fastening bolt can be inserted and screwed into a threaded hole 40 within the fixture 32.

In the region of the cable drum 18, the front wall 28 has an opening 42 through which a pinion 44 on the crank handle drive 14 can pass to afford engagement of the pinion with an inner toothing 46 on the cable drum 18. As viewed in FIG. 1, the lower portion of the opening 42 includes a wall 45 projecting perpendicularly inwardly in the form of a partial hollow cylinder. Wall 45 includes a bearing wall 48 extending perpendicularly to the axis 26 and wall 48 has an annular contour. Cable drum 18 is rotatably supported on the outer circumferential surface of the bearing wall 48 and the drum 18 has a recess 50 concentric with the axis 26. The cylindrically shaped circumferential surface 52 in the recess 50 contacts the outer circumferential surface of the bearing wall 48. Moreover, a bearing bore 54 is located in the wall 48 for receiving an axially extending pinion pin 56 projecting from the right-hand end of the pinion 44. The walls 45, 48 are arranged within the interior of the housing and are supported by the front wall 28 and thereby form a bearing 58 for the cable drum 18 as well as for the pinion 44. Similar to the front part 22, the rear part 24 has a wall 60 extending perpendicular to the axis 26 and a cylindrical collar 62 aligned with and in contact with the collar on the front part 22 forming a hollow cylindrical interior space within which the cable drum 18 is located. An opening 64 in the rear wall 60 concentric to the axis 26 permits the insertion of a bearing shaft 66, note the right-hand part in FIG. 1 and a driving claw part 68 into the housing 20. The end of the bearing shaft 66, shown at the left in FIG. 1, fits into a central bearing bore 70 in the cable drum 18. As shown in section in FIG. 2, radially extending approximately star-shaped jaws 72 formed on the driving claw part 68 project into a complementary star-shaped jaw recess 74 on the right-hand face of the cable drum 18 as viewed in FIG. 1 with an elastic intermediate layer 76 provided within the recess 74. The layer 76 is an optional feature.

The two housing parts 22, 24 are screwed or clipped together after the cable drum is inserted. If the parts are clipped together, axially extending barb-shaped clip projections 78 are formed on the outer circumference of one collar 62, note FIG. 1, and these projections 78 engage in corresponding clip recessed 80 in the other collar 30, note the lower portion of the center part in FIG. 1. Another such clip connection can be provided with a clip hook 82 formed on the front wall 28 and extending toward the rear part 24 into a clip recess 84 formed in a flange 86 extending perpendicularly to the drum axis 26 on an edge of the collar 62, note the upper part in FIG. 1. Moreover, the recess 84 can also form an opening for a screw connection of the housing 20 with the motor drive 16 or, more specifically, with a motor drive hood 88. As displayed in FIG. 2, the motor drive hood 88 is provided with four outwardly projecting fastening tabs 90 each containing a fastening hole 92. The fastening hole 92, shown at the upper left in FIG. 2, aligns with the recess or opening 84 in the flange 86 as well as with an opening 94 in the front wall 28 adjoining opening 84 and with an opening 94 provided in the rear wall 60.

The substantially cylindrical outer circumference of the cable drum 18 is provided with cable grooves 98, as shown in FIG. 1. In addition to the central support of the cable drum 18 on the bearing member 58, the cable drum is also supported on the inner surfaces of the front and rear walls 28, 60 by means of a rotating, axially extending projection 100 on each of the faces of the cable drum extending transversely of the drum axis. Both of the annular projections 100 encircle the corresponding openings 42, 64 and thus provide a seal toward the outside of the annular take-up space 102 encircling the cable drum 18. This is important because only one drive, either the crank handle drive 14 or the motor drive 16, is connected with the housing during assembly and, therefore, one of the two openings 42, 64 remains free or open. The construction of the motor drive 16 can be noted from FIGS. 1 and 2. Motor drive hood 88, mentioned above, forms a bearing for the right end of the bearing bolt 66, as viewed in FIG. 1. Accordingly, an axle journal 104 is formed by the hood with an inside diameter adapted to the diameter of the bearing bolt 66. The axle journal 104 is formed in the middle part of the base 106 of the motor drive hood 88. The base 106 is reinforced by radially extending ribs 108. A worm wheel 110 located below the bearing shaft 66 meshes with a worm 112 shown in dashed lines in FIGS. 1 and 2. Worm 112 is flanged onto the shaft of the electric motor 34, not shown in detail.

Worm wheel 110 rotates the driving claw part 68 with an oscillating and impact dampening intermediate layer 114 between them. Accordingly, the driving claw part 68 has four axially extending projections 116 extending toward the right in FIG. 1 and indicated by dot-dash lines in FIG. 2. To save weight the carrying projections 116 are formed with a hollow space open toward the right. Carrying projections 116 are inserted into circular sector-like recesses 122 in the worm wheel 110 with the recesses separated from one another by radial webs 120. The carrying projections 116 do not come in direct contact with the webs 120, since the projections 116 are separated from the webs 120 by the elastic intermediate layer 114. A hollow space 128 formed between the inner circumferential surface 124 of the worm wheel 110 and an outwardly directed stepped face 126 on the intermediate layer 114 serves as a compensation space for the elastic intermediate layer 114 formed, for example, of rubber when a reciprocal turning of the worm wheel 110 and the driving claw part 68 takes place. The driving claw part 68 includes a relatively thin annular disc 130 on its radially outer end adjoining the projections 116. In this region, the elastic intermediate layer 114 is also formed annularly and is clamped in a sealing manner between the annular disc 130 and the juxtaposed end face of the worm wheel 110. A sealing lip 132 is formed on the outer circumference of the elastic intermediate layer 114 and serves as a seal for the interior of the motor drive hood 88. The sealing lip 132 contacts the interior surface 134 of the hood in a sealing manner in the region of the edge of the motor drive hood.

To prevent a spray of water from penetrating between the rear wall 60 and the motor drive hood 88, an O-ring-like annular sealing section 136 is provided on the outer circumference of the elastic intermediate layer 114 and it is clamped between the annular end face 138 on the hood and a sealing web 140 on the rear wall during assembly. Since the annular sealing section 136 is connected with the disc-shaped elastic intermediate layer 114 by only a thin material film 142, this film tears when the motor drive is set in motion. The sealing section 136 remains in place, particularly when the annular faces of the web 140 or the edge of the motor drive hood 88 which face one another, are curved inwardly.

It should also be noted that the driving claw part 68 is rotatably supported on the axle journal 144 of the worm wheel 110 and the journal projects to the left in FIG. 1 and ensures a compact constructional form and a stable worm wheel support.

If the window lifter drive is to be manually driven, the crank handle drive 14 is attached to the housing 20 from the left in FIG. 1, and the motor drive 16 is not mounted on the housing. The crank handle drive includes a loop spring brake 150 comprising a loop spring 152 supported in its at rest position against the inner circumferential surface of an annular shaped loop spring brake jacket 154. The loop spring 152 is carried along during actuation of the crank handle 156 by a jaw part 158 rigidly secured with the crank handle 156 and it is released from the inner circumferential surface of the loop spring brake jacket 154 by another jaw part 160. Jaw parts 158 and 160 form a jaw coupling or clutch. Jaw part 160 is formed integrally with the pinion 44. A bearing bolt 162 formed integrally with the jaw part 160 extends into the other jaw part 158 and is axially fixed to the crank handle 156 by a nut 164 screwed onto a thread 166 at the free end of the bolt. Bolt 162, however, can turn relative to the crank handle 156.

The rotating coupling between the crank handle 156 and the jaw part 158 is obtained by a bolt or shaft provided with exterior ribbing 168 and the shaft is formed integrally with the jaw part 158 and fits within a recess 170 in the crank handle 156 which recess also is ribbed.

To connect the loop spring brake jacket 154 with the base 12, the jacket is provided with a radially projecting annular flange 172 which can be secured to the front wall 28 of the housing 20. A fastening hole 174 with an interior thread is provided in the flange 172 and it aligns with the holes 94, 84, and 96.

To secure the crank handle 156 and the loop spring brake 150 on the interior door panel 186 or on a carrier, either together with or separate from the base 12, a flange 176 is used. Flange 176 is supported in the axial direction on one side against the edge of a crank hood 180 formed integrally with the crank handle 156. The flange 176 is concentric with the crank axis 178 and forms an open space in the right-hand direction of FIG. 1. The other side of the flange 176 bears against a wall 182 extending transversely of the crank axis 178, the wall 182 forming a part of the loop spring brake 150. Wall 182 forms a bearing opening 184 for the bolt or pin 169 on which the jaw part 158 is formed. During the assembly of the window lifter drive, for example, on the interior door panel 186 of the motor vehicle door, the approximately annular flange 176 is inserted in an opening 188 in the panel 186. Specifically, the flange 176 forms a collar 190 projecting rightward in FIG. 1 and fitted into the opening 188. To prevent the flange 176 from rotating along with the crank handle 156, axially extending projections 192 are formed at one or several locations on the outer circumferential periphery of the flange 176 and these projections engage in a form-locking manner in corresponding recesses 194 in the interior door panel 186.

Furthermore, nut 164 is covered outwardly by a plate 196 secured to the hood 180 by clip hooks 198.

When the crank handle 156 and the loop spring brake 150 are mounted on the interior door panel 186, the loop spring brake is inserted from one side, that is from the right in FIG. 1, through the mounting opening 188 with the bolts or pins 169, 162 projecting toward the left and carrying the jaw parts 158, 160. First the flange 176 and then the crank handle 156 are inserted into position from the other side. After the nut 164 is secured onto the thread 166 the plate 196 is clipped to the hood 180.

Figure 3:
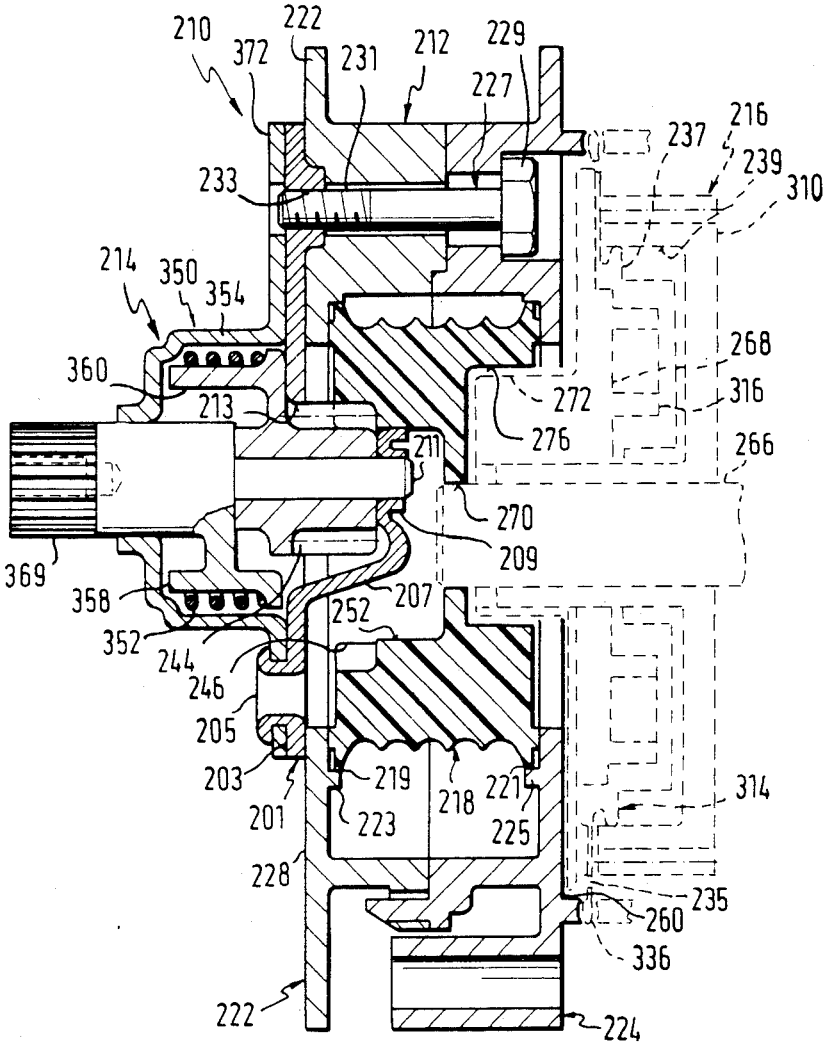
FIG. 3 is a sectional view of another embodiment of the window lifter drive incorporating the present invention shown in the assembled condition.

Another window lifter drive 210 similar to that shown in FIG. 1 is illustrated in FIG. 3. The components corresponding to the window lifter in FIG. 1 have the same reference numerals with the addition of 200.

In window lifter drive 210, a crank handle drive 214 is shown screwed onto the base 212. Motor drive 216, which can be mounted as an alternative, is illustrated in phantom in the position it would adopt if it were mounted on the base 212.

The essential difference between the arrangements in FIGS. 1 and 3 is involved in the make-up of the crank handle drive 214. A loop spring brake jacket 354 is closed toward the right by a bearing unit 201. Bearing unit 201 has a radially outer, annular shape circumferential area 203 in contact with a radial flange 372 formed on the loop spring brake jacket 354. The flange 372 extends in a planar manner outwardly from the brake jacket 354. As shown in the lower portion of FIG. 3, a rivet 205 rigidly connects the two parts together. In the region of the pinion 244, bearing unit 201 has an axially extending bearing section 207 approximately Z-shaped in the cross-section of FIG. 1 and the bearing section 207 is engaged in a recess 252 in the cable drum 218. The upper end of section 207, as viewed in FIG. 3, has a bearing opening 209 which receives a bearing pin 211. Bearing pin 211 extends axially from a shaft-like member 369 with the jaw part 358 formed integrally with the shaft-like member and rigidly connected to the crank handle, not shown. Pinion 244 and another jaw part 360 formed integrally with the pinion, are rotatably supported on the bearing pin 211. Both jaw parts 358, 360 are, in turn, coupled with one another by the loop spring 352. To achieve engagement of the pinion 244 with the corresponding inner toothing 246 of the cable drum 218, the bearing unit 201 is provided with a recess 213.

Bearing section 207 can, corresponding to the bearing section 58 in FIG. 1, be formed to rotatably support the cable drum 218. To achieve a sufficiently stable rotatable support of the cable drum 218, if an electric motor drive is used, cable drum 218 is rotatably supported on the two parts 222,224 of the base 212. For this purpose, the cable drum edges 219, 221 are encompassed by guide webs 223, 225 formed on the inner side of the front wall 228 and the rear wall 260.

Bolts 227, one is shown in the upper part of FIG. 3, fasten the crank handle drive 214 on the base 212. Bolt 227 is supported on the rear part 224 by its head 229. The bolt 227 extends through the front part 222 and its thread 231 is screwed into a corresponding inner thread 233 in the bearing unit 201. As mentioned above, the bearing unit 201 is firmly connected with the loop spring brake 350 by means of the rivets 205.

If the motor drive 216 is to be secured on the base 212 in place of the crank handle drive 214, then the arrangement shown in phantom in FIG. 3 takes place. Bearing bolt 266 engages in a corresponding recess 270 in the cable drum 218. Driving claw part 268 engages by its claws 272 in corresponding recesses 276 formed in the cable drum 218 and optionally an elastic intermediate layer may be placed between them. Carrying projections 316 on the driving claw part 268 couple the driving claw part with the worm wheel 310 and an elastic intermediate layer may be placed between them. A cap 235 can be seen in FIG. 3 between the annular sealing section 336 and elastic intermediate layer 314. In contrast to FIG. 1, a sealing lip 237 is provided on the elastic intermediate layer 314 and it is in sealing contact with an inner circumferential surface 239 of the worm wheel 310.

Figure 5:
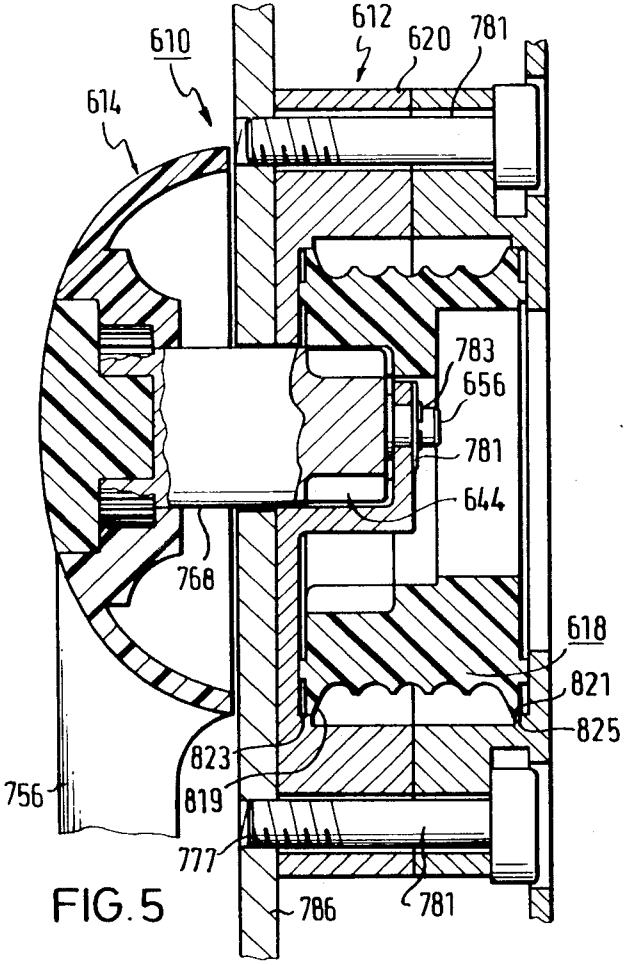
FIG. 5 is a sectional view of a fourth embodiment of the present invention.
Figure 4:
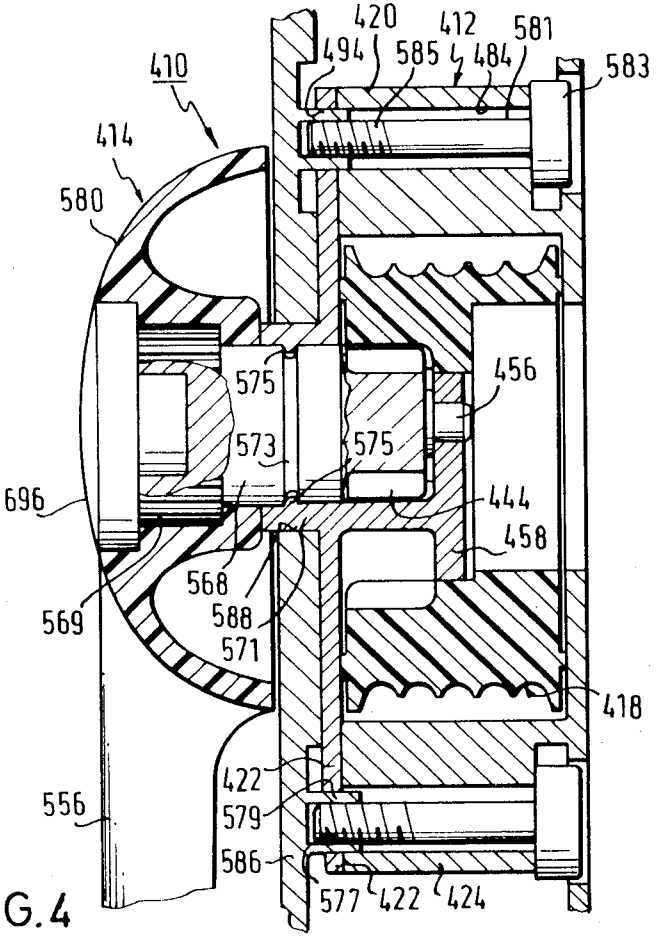
FIG. 4 is a sectional view of a third embodiment of the present invention.

Additional embodiments of the window lifter drive, embodying the present invention, are displayed in FIGS. 4 and 5. Window lifter drive 410 as shown in FIG. 4 and window lifter drive 610 shown in FIG. 5. Both of these embodiments are directed to the crank handle drive of the cable drum. It would be possible, however, in each of embodiment to replace the crank handle drive with an electric motor drive.

Components in FIG. 4, corresonding to those in FIG. 1, are identified by the same reference numerals with the addition of 400. Components in FIG. 5 are similarly identified with the same reference numerals as in FIG. 1, however, with the addition of 600.

Crank handle drives 414 and 614 are distinguished from the crank handle drives 14 and 214 in that the loop spring brake is not used. Accordingly, crank handles 556 and 756 are rigidly connected directly with the pinion 444 and 644. Both embodiments 410 and 610, shown in FIGS. 4 and 5, are differentiated from one another only in the different axial placement and securement of the pinion 444 and 644 in the base 412 and 612.

In FIG. 4, pinion 444 is formed integrally with bolt 568 which has a head 569 at its opposite ends from the pinion 444. Head 569 has an enlarged diameter as compared to that of the bolt 568 and it is provided with ribbing on its exterior surface. The head 569 is secured against rotation in a correspondingly ribbed recess in the crank hood 580. A closure or stopper 696 covers the head 569 on the outside of the crank handle drive 414.

The construction of the base 412 corresponds substantially to that of the base 12 in FIG. 1. Forming base 412 is a two-part housing 420 including a front part 422 formed with a bearing section or projection 458 serving to rotatably support the cable drum 418, bearing projection 458 also supports pinion pin 456 extending axially outwardly from the end of the pinion 444. Both housing parts 422, 424 can be clipped together.

In addition, the front part 422 forms an axle journal 571 providing rotatable support for the bolt 568. To secure the bolt 568 in the axial direction, it is provided with a circumferentially extending groove 573 in its outer surface which engages several barbed-like projections 575 formed on the inner surface of the axle journal 571. As viewed in FIG. 4, the left sides of the projections 575 form an inclined abutment surface and the right sides form a radial support surface so that it is possible to insert the bolt 568 from left to right with the projection 575 yielding, however, bolt displacement in the opposite direction is impossible due to the arrangement of the projections.

As shown in FIG. 4, base 412 is fastened directly on an interior door panel or carrier 586. Axle journal 571 passes through an opening 588 in the panel or carrier 586. Cylindrical fastening projections 579 containing inner threads 577 project perpendicularly from the carrier 586 and engage in corresponding openings 494, 484 in the front part 422 and the rear part 424, respectively. Bolts 581 have their heads 583 bearing against the rear part 422 and are screwed to the interior threads 577 by means of the threads 585 on the bolts.

With the base 412 fitted onto the carrier 586 in an early assembly stage of the window lifter drive, the drive can be completed in a subsequent assembly operation by mounting a crank handle drive 414 or a motor drive, not shown in FIG. 4, as desired. If the crank handle drive 414 is to be attached, it is necessary only to secure the crank handle 556 from the left in FIG. 4 to the bolt 568. If a motor drive is to be mounted, it can be attached to the base 412 from the right in FIG. 4.

Window lifter 610, exhibited in FIG. 5, is different from the window lifter drive 410 in FIG. 4, only instead of securing the bolt in the axial direction by means of the groove 573 and the projections 575, the axial securement is afforded by a self-locking washer or disc 781. Radially inwardly projecting spreading tabs 783 on the disc 781 can be noted which dig increasingly into the outer circumference of the pinion pin 656 when the bolt 768 is pulled out in the direction to the left in FIG. 5.

The attachment of the base 612 on the carrier 786 is also somewhat simplified. Screw bolts 781 are directly screwed into corresponding threaded boreholes 777 in the carrier 786.

The support of the cable drum 618 on the housing 620 is effected in a manner similar to that in FIG. 3, that is, by way of the webs 823, 825 encircling the cable drum edges 819,821.

In the embodiments illustrated in the drawing, the driving member positioned in the housing is a cable drum of a cable operated window lifter. It would be possible, however, to use a toothed sector of a gear window lifter.

While specific embodiments of the invention have been shown and described in detail to illustrate the application of the inventive principles, it will be understood that the invention may be embodied otherwise without departing from such principles.

I claim:

1. Window lifter drive such as used in motor vehicles, comprising a housing and a driving member mounted in said housing and having an axis of rotation, said housing having a first side wall on one side of the housing and second side wall on the opposite side of the housing, a manual crank handle drive being selectively securable to said first side wall in permanent driving engagement with said driving member, and a motor drive being selectively securable to said second side wall in permanent driving engagement with said driving member, whereby a manually operable window lifter drive is obtainable by only securing said manual crank handle drive to said housing and a motor operable window lifter drive is obtainable by only securing said motor drive to said housing, said crank handle drive includes a pinion selectively engageable with said driving member, a crank handle, and a clutch connecting said crank handle and said pinion, said clutch comprising a loop spring brake, said clutch including a first clutch part rigidly connected with said pinion and a second clutch part rigidly connected with said crank handle, said loop spring brake includes a loop spring brake jacket fixed to said housing, a bearing section is fastened to said loop spring brake jacket, said driving member comprises a cable drum having a central recess therein, said bearing section projects into said central recess in said cable drum, said crank handle drive includes a pinion extending into said central recess and rotatably supported in said bearing section, said bearing section having an opening therethrough, said crank handle drive including a pinion pin disposed in axial alignment with and supported in the opening in said bearing section, and said pinion is rotatably supported on said pinion pin.

2. Window lifter drive, as set forth in claim 1, wherein said housing is divided into a first part and a second part secured together in a plane extending transversely of the axis of rotation of said driving member and said first part forming said first side wall and said second part forming said second side wall, said first side wall having an opening therethrough, said second side wall having an opening therethrough, said crank handle drive having a pinion insertable through the opening in said first side wall into a driving contact with said driving member, and said motor drive having a driving member insertable through said opening in said second side wall into a driving contact with said driving member.

3. Window lifter drive, as set forth in claim 2, wherein said first and second parts of said housing are clipped together.

4. Window lifter drive, as set forth in claim 1, wherein said pinion and said first clutch part is rotatably mounted relative to said second clutch part.

5. Window lifter drive, as set forth in claim 1, wherein said bearing section is riveted to said loop spring brake jacket.

6. Window lifter drive, as set forth in claim 1, wherein said crank handle drive includes a flange extending transversely of the axis of rotation of said driving member, and a crank handle, said flange located between said crank handle and said loop spring brake jacket.

7. Window lifter drive, as set forth in claim 1, wherein the pinion bolt connects said crank handle and said pinion, said pinion bolt having a circumferentially extending groove formed in the outside surface thereof, and barb-shaped radially inwardly directed elastically yielding projections are formed on said housing for engagement within said groove on said pinion bolt.

8. Window lifter drive, as set forth in claim 1, wherein said motor drive comprises a bearing shaft, said housing having an opening therein in said second side wall thereof, said driving member having a central bearing opening therein in alignment with the opening in the second side wall of said housing, and said bearing shaft extending through said housing into said central bearing opening in said driving member with said bearing shaft rotatably supported within said central bearing opening.

9. Window lifter drive, as set forth in claim 8, wherein said bearing shaft having a first end thereof mounted in said central bearing opening, said motor drive includes a motor drive hood, said bearing shaft having a second end thereof rotatably supported in said motor drive hood, and said motor drive hood is attachable to said housing.

10. Window lifter drive, as set forth in claim 8, wherein said motor drive includes a worm wheel supported on said bearing shaft.

11. Window lifter drive, as set forth in claim 10, wherein said motor drive includes a driving claw part engageable with said driving member for connecting said worm wheel to said driving member.

12. Window lifter drive, as set forth in claim 11, wherein an elastic intermediate part is provided between said worm wheel and said driving claw part.

13. Window lifter drive, as set forth in claim 11, wherein an elastic intermediate part is provided between said driving claw part and said driving member.

14. Window lifter drive as set forth in claim 1, wherein said first side wall has an opening therethrough, said crank handle drive having a first coupling means insertable through said opening in said first side wall for coupling movement of said crank handle drive with said driving element and wherein said second side wall has an opening therethrough, said motor drive having a second coupling means insertable through said opening in said second side wall for coupling movement of said motor drive with said driving member.

15. Window lifter drive as set forth in claim 14, wherein said driving element is rotatably mounted on said first side wall and on said second side wall of said housing.

16. Window lifter drive as set forth in claim 14, wherein said crank handle drive has a pinion insertable through said opening in said first side wall, and said driving member has an interior toothing therein facing the opening in said first side wall for meshed engagement with said pinion.

17. Window lifter drive as set forth in claim 16, wherein said motor drive has a driving claw part insertable through the opening in said second wall, and said driving member has a recess for receiving said driving claw part for joint rotation of said driving member and said driving claw part.

18. Window lifter drive as set forth in claim 17, wherein said driving member is a cable drum.

19. Window lifter drive, as set forth in claim 18, wherein said cable drum having a first side and a second side with each of said sides extending transversely of the axis of rotation of said cable drum, said cable drum having a radially outer circumferentially extending surface, and said outer circumferentially surface having an annular surface thereon adjacent each of said first and second sides of said cable drum and corresponding surfaces formed on the interior of said housing in contact with said annular surfaces of said cable drum for rotatably supporting said cable drum.

20. Window lifter drive, as set forth in claim 18, wherein said housing comprising a bearing projection extending inwardly from one of said first side wall and second side wall thereof, and said cable drum having a radially inner circumferential surface therein in contact with said bearing projection on said housing for rotatably supporting said cable drum.

21. Window lifter drive such as used in motor vehicles, comprising a housing and a driving member mounted in said housing and having an axis of rotation, said housing having a first side wall on one side of the housing and a second side wall on the opposite side of the housing, a manual crank handle drive being selectively securable to said first side wall in permanent driving engagement with said driving member, and a motor drive being selectively securable to said second side wall in permanent driving engagement with said driving member, wherein a manually operable window lifter drive is obtainable by only securing said manual crank handle drive to said housing and a motor operable window lifter drive is obtainable by only securing said motor drive to said housing, said first side wall has an opening therethrough, said crank handle drive having a first coupling means insertable through said opening in said first side wall for coupling movement of said crank handle drive with said driving element and wherein said second side wall has an opening therethrough, said motor drive having a second coupling means insertable through said opening in said second side wall for coupling movement of said motor drive with said driving member, said crank handle drive has a pinion insertable through said opening in said first side wall, and said driving member has an interior toothing therein facing the opening in said first side wall for meshed engagement with said pinion, said motor drive has a driving claw part insertable through the opening in said second wall, and said driving member has a recess for receiving said driving claw part for joint rotation of said driving member and said driving claw part, said driving member is a cable drum, said housing comprising a bearing projection extending inwardly from one of said first side wall and a second side wall thereof, and said cable drum having a radially inner circumferential surface therein in contact with said bearing projection on said housing for rotatably supporting said cable drum, said crank handle drive includes a pinion insertable into said cable drum for driving said cable drum, and said pinion is rotatably supported within said housing in said bearing projection.

22. Window lifter drive such as used in motor vehicles, comprising a housing and a driving member mounted in said housing and having an axis of rotation, said housing having a first side wall on one side of the housing and a second side wall on the opposite side of the housing, a manual crank handle drive being selectively securable to said first side wall in permanent driving engagement with said driving member, and a motor drive being selectively securable to said second side wall in permanent driving engagement with said driving member, whereby a manually operable window lifter drive is obtainable by only securing said manual crank handle drive to said housing and a motor operable window lifter drive is obtainable by only securing said motor drive to said housing, said crank handle drive includes a crank handle and a pinion fixed to said crank handle, said pinion includes a pinion pin projecting from the end thereof remote from said crank handle, said housing includes a bearing section having a bearing opening therein, and said pinion pin is supported in the bearing opening in said bearing section.

23. Window lifter drive, as set forth in claim 22, including means mounted on said pinion pin on the opposite side of said bearing section from said crank handle for securing said pinion pin against axial displacement in the direction of said crank handle.

24. Window lifter drive, as set forth in claim 23, wherein said means comprises a self-locking disc secured on said pinion pin with said disc bearing against said bearing section.

25. Window lifter drive such as used in motor vehicles, comprising a housing, a driving member having an axis of rotation mounted in said housing, and a manual crank handle drive and a motor drive for driving said driving member, wherein the improvement comprises that said housing has a first side and a second side extending transversely of the axis of rotation of said driving member, one of said manual crank handle drive and motor drive is selectively securable to said first side of said housing in driving engagement with said driving member, and the other one of said manual crank handle drive and motor drive is selectively securable to said second side of said housing in driving engagement with said driving member, said motor drive comprises a bearing shaft, said housing having an opening therein in said second side thereof, said driving member having a central bearing opening therein in alignment with the opening in the second side of said housing, and said bearing shaft extending through said housing into said central bearing opening in said driving member with said bearing shaft rotatably supported within said central bearing opening, said motor drive includes a worm wheel supported on said bearing shaft, said motor drive includes a driving claw part engageable with said driving member for connecting said worm wheel to said driving member, an elastic intermediate part is provided between said worm wheel and said driving claw part, said elastic intermediate part laterally encircles said bearing shaft and has a radially inner and a radially outer circumference, the radially outer circumference of said elastic intermediate part has an annular sealing section for effecting a seal between said motor drive hood and said housing.

26. Window lifter drive, as set forth in claim 25, wherein an annular film connection part connects said annular sealing section with said elastic intermediate part located radially inwardly of said film connection part so that said film connection part can separate said annular sealing section from said elastic intermediate part located radially inwardly therefrom.

27. Window lifter drive such as used in motor vehicles, comprising a housing, a driving member having an axis of rotation mounted in said housing, and a manual crank handle drive and a motor drive for driving said driving member, wherein the improvement comprises that said housing has a first side and a second side extending transversely of the axis of rotation of said driving member, one of said manual crank handle drive and motor drive is selectively securable to said first side of said housing in driving engagement with said driving member, and the other one of said manual crank handle drive and motor drive is selectively securable to said second side of said housing in driving engagement with said driving member, said driving member is a cable drum, said cable drum has a first side and a second side each extending transversely of the axis of rotation thereof, said first side of said cable drum is supported on said first side of said housing and said second side of said cable drum is supported on said second side of said housing and each of said first side and second side of said housing having an opening therethrough in communication with said cable drum, each of said first and second sides of said cable drum have an axially extending annular projection thereon spaced radially outwardly from the opening in the adjacent said side of said housing and arranged to contact the adjacent side of said housing.

* * * * *